United States Patent [19]

Morris et al.

[11] Patent Number: 4,969,514

[45] Date of Patent: Nov. 13, 1990

[54] APPARATUS FOR RETRIEVING PIPE SECTIONS FROM A WELL BORE

[76] Inventors: George H. O. Morris, 10 Murray Avenue, Tarves, Ellon, Aberdeen, Scotland; Robert F. Mitchell, 15 Bleachfield Road, Bridge of Don, Aberdeen, Scotland

[21] Appl. No.: 706,969

[22] Filed: Mar. 1, 1985

[30] Foreign Application Priority Data

Mar. 2, 1984 [GB] United Kingdom ..... 8405488
Jul. 4, 1984 [GB] United Kingdom ..... 8416970

[51] Int. Cl.[5] ..... E21B 29/08

[52] U.S. Cl. ..... 166/55; 166/55.7; 294/86.34

[58] Field of Search ..... 166/55–55.3, 166/55.6–55.8, 297, 298, 98; 294/86.34

[56] References Cited

U.S. PATENT DOCUMENTS

| | | | |
|---|---|---|---|
| 1,830,207 | 11/1931 | Mueler | 166/55.7 |
| 1,867,289 | 7/1932 | Ventresca | 166/55.7 |
| 2,117,050 | 5/1938 | Wilson | 166/55.7 |
| 3,747,674 | 7/1973 | Murray | 166/98 |
| 3,983,936 | 10/1976 | Kennard et al. | 166/55.8 X |
| 4,047,568 | 9/1977 | Aulenbacher | 166/298 |
| 4,099,561 | 7/1978 | Nelson | 166/55.1 |
| 4,191,255 | 3/1980 | Rives | 166/55.7 X |
| 4,550,781 | 11/1985 | Kagler, Jr. | 166/55.7 X |

FOREIGN PATENT DOCUMENTS

| | | |
|---|---|---|
| 1590453 | 6/1981 | United Kingdom . |
| 1590454 | 6/1981 | United Kingdom . |

*Primary Examiner*—James A. Leppink
*Attorney, Agent, or Firm*—Marshall, O'Toole, Gerstein, Murray & Bicknell

[57] ABSTRACT

An apparatus for retrieving a pipe section from a well bore includes a structure to be connected to the lower end of a drilling string. The structure includes a cutter at its lower end and a controllable gripping member for gripping the interior of a pipe section. The gripping member is located above the cutter and is adapted to grip the interior of the pipe. The gripping member is such that when in a gripping condition the gripping member remains stationary while the drilling string and the cutter are rotated.

10 Claims, 3 Drawing Sheets

APPARATUS FOR RETRIEVING PIPE SECTIONS FROM A WELL BORE

BACKGROUND TO THE INVENTION

The present invention relates to an apparatus for retrieving pipe sections from a well bore, and in particular relates to a releasable spear for retrieving pipe sections from a well bore such as an under-sea well bore.

It has been proposed to provide a spear for retrieving sections of a pipe from a well bore. The spear has a radially expandable cutter adjacent the bottom, and immediately above the cutter an expandable grapple. The grapple is firmly connected to the drill string and thus rotates with the drill string. A marine swivel is also mounted on the drill string at a position above the grapple to rest on top of the pipe section being cut.

When a pipe section is to be cut the described spear is inserted into the upper end of the pipe until the marine swivel rests on the top of the pipe. This enables the drilling string tension created by the weight of the spear to be released. The drill string is then rotated to enable the cutter to cut the pipe and the grapple, located inside the pipe, may be expanded to grip the inside of the pipe. After the pipe has been cut the severed part of the pipe is brought to the surface by applying tension to the drilling string.

The prior proposed spear has the disadvantage that it can only be utilised to retrieve relatively short sections of a pipe at a time, and if a long section of pipe has to be retrieved, severe difficulties may be encountered. Also it is to be noted that the drilling string is relaxed during the cutting process, thus making it necessary to provide a marine swivel, which is relatively expensive.

The present invention seeks to provide an improved apparatus for retrieving a pipe from a well bore.

BRIEF SUMMARY OF THE INVENTION

According to this invention there is provided an apparatus for retrieving a pipe section from a well bore, said apparatus comprising a structure adapted to be connected to the lower end of a drilling string, said structure including a cutter at or adjacent its lower end, and controllable gripping means for gripping the interior of a pipe section, the gripping means being located above the cutter and being adapted to grip the interior of the pipe, the gripping means being such that when in a gripping condition the gripping means may remain stationary whilst the drilling string and the cutter are rotated.

Preferably the cutter is adapted to be hydraulically actuated by means of hydraulic fluid or "mud" supplied through the drilling string.

Advantageously the gripping means include a structure rotatably and axially movable on a mandrel located between an upper part of the drilling string and said cutter, dis-engageable clutch means being provided for enabling rotation of said structure on initial rotation of the drilling string, the gripping means firmly gripping the interior of the pipe as a consequence of said rotation.

In one embodiment the gripping means include an inner sleeve mounted on the mandrel for rotational and axial movement relative thereto, the inner sleeve being provided at its upper end, with teeth engageable with corresponding teeth provided at the lowermost end of the next adjacent element in the drill string to constitute the said disengageable clutch means and the inner sleeve being provided with cam means adjacent the lower end thereof, there being an outer tubular member surrounding the inner sleeve defining, adjacent its lower end, a plurality of flexible fingers the ends of which carry gripping elements, the outer tubular member being adapted to be maintained initially in an elevated position relative to the inner sleeve, rotation of the inner sleeve permitting the outer tubular member to move to a lower position when the ends of the fingers engage the cam surfaces so that the ends of the fingers are moved radially outwardly to grip the interior of the pipe securely.

Preferably the outer tubular member is provided with a plurality of slots between said fingers and the inner tubular member is provided with a plurality of abutment members, the arrangement being such that initially the abutment members engage the ends of said fingers, but on rotation of the inner tubular member the abutment members are brought into coalignment with said slots, thus permitting the outer member to move downwardly relative to the inner sleeve.

In another embodiment the gripping means comprise a member mounted on the mandrel for rotational and axial movement, the member defining a screw-thread on an outer portion thereof, engageable with a corresponding screw-thread provided on the interior of a pipe, the member being provided with clutch means adapted releasably to engage with corresponding clutch means provided on the next adjacent member of the drill string.

In a further embodiment the gripping means comprise an assembly mounted on the mandrel for axial and rotational movement, the assembly being provided with clutch means to engage with corresponding clutch means on the next adjacent member of the drill string the assembly being such that when a rotational movement is imparted to part thereof a plurality of gripping elements are moved radially outwardly to engage the interior of the pipe.

Preferably the assembly comprises an inner element mounted on the mandrel for axial and rotational movement, and an outer element is rotatably mounted on the inner element, the outer element carrying a plurality of radially movable inwardly spring biassed pins, the inner element defining cam faces cooperating with the heads of the pins such that on movement of the inner member relative to the outer member the pins are moved radially outwardly.

BRIEF SUMMARY OF THE DRAWINGS

In order that the invention may be more readily understood, and so that further features thereof may be appreciated, the invention will now be described, by way of example, with reference to the accompanying drawings in which.

DETAILED DESCRIPTION OF THE INVENTION

Figure 1:
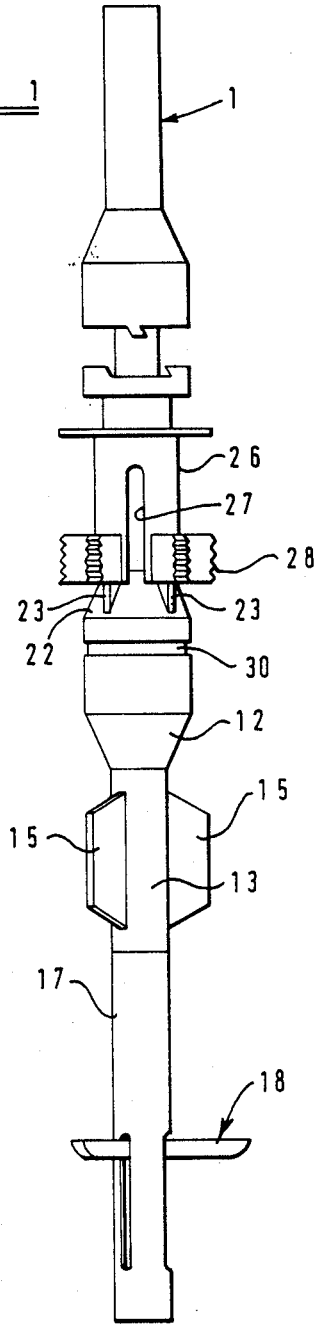
FIG. 1 is a view of a spear in accordance with the invention in one condition.
Figure 2:
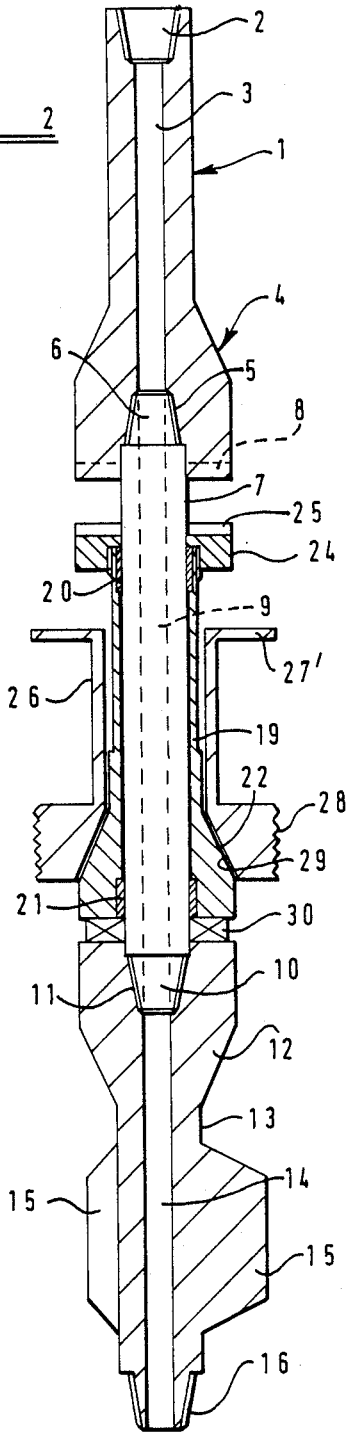
FIG. 2 is a vertical sectional view of part of the spear of FIG. 1 in another condition, with the cutter omitted.

Referring initially to FIGS. 1 and 2 of the accompanying drawings a spear in accordance with the invention is adapted to be mounted at the bottom of a drill string so as to be rotatable with the drill string. The spear terminates, at its lower end, with a pipe cutter which can be operated to cut the pipe. At a position above the pipe cutter the spear is provided with means which can grip the interior of the pipe into which the spear has been introduced and the arrangement is such that when the gripping means have gripped the pipe the entire drill string can still be rotated so as to operate the cutter.

Considering the embodiment shown in FIGS. 1 and 2 in more detail the spear comprises an upper tubular element 1, which has, at its upper end, a conventional top box connector 2 which defines a conically tapering thread for engagement with a bottom pin connector provided at the lower end of the remaining part of the drill string.

The element 1 defines an axial bore 3 through which hydraulic fluid or "mud" may be supplied.

The lower end 4 of the member 1 is of enlarged diameter and defines a bottom box connector 5 adapted to receive a top pin connector 6 of a tubular mandrel 7. Part of the lower surface of the enlarged part 4 of the member 1 is adjacent the member 7 and defines a plurality of downwardly extending "teeth" 8 which, as will be described hereinafter, form part of a dog clutch.

The mandrel 7 is of tubular construction defining a central bore 9 which communicates with the bore 3 of the element 1. At its lower end the mandrel 7 is provided with a bottom pin connector 10 which engages in a top box connector 11 formed in the upper part 12 of a further tubular member 13 which defines a central axial bore 14 communicating with the bore 9. The member 13 may carry a plurality of radially extending stabilizing fins 15. At its lower end the member 13 is connected by means of a bottom pin connector 16 to a top box connector provided in a pipe cutter 17. As can be seen in FIG. 1 the pipe cutter 17 has a plurality of arms 18 which can be moved hydraulically to an extended position, as illustrated in FIG. 1, and when in this extended position as the drill string is rotated the rotational movement is imparted to the cutter and thus the pipe can be cut.

The means provided in the embodiment shown in FIGS. 1 and 2 that grip the interior of a pipe to be cut surround the mandrel 7.

A tubular sleeve 19 surrounds the mandrel, and the sleeve is provided with cylindrical bushes 20, 21 provided at each end of the sleeve. The bushes may be made of ceramic material or brass and enable the sleeve 19 to move axially of the mandrel 7 and also enable the sleeve to rotate relative to the mandrel 7 or, in other words, to enable the mandrel 7 to rotate relative to the sleeve 19.

At its lowermost end the sleeve 19 is provided with a conical portion 22. This is an outwardly tapering portion the upper part of which is of lesser diameter than the lower part. A plurality of vertical triangular plates 23 are provided at radially spaced positions which extend out from the tapering surface of the tapering portion 22. Each plate 23 has a horizontal upper edge. At its upper end the tubular member 19 is provided with a nut-like member 24 which is securely connected to the upper part of the tubular member 19. The nut has, at its upper edge an inwardly directed flange which serves to retain the bearing 20 in position. On its upper surface the nut 24 is provided with a plurality of upwardly extending "teeth" 25 which cooperate with the above-mentioned teeth 8 to form a dog clutch.

The nut-like member 24 serves to retain, on the exterior of the sleeve 19, a slidable clamping member 26. The clamping member 26 is of generally tubular construction having an outwardly directed flange 27 at the top thereof. At its lower end the tubular clamping member is divided into a plurality of separate fingers by means of vertical slots 27 which extend upwardly from the bottom end thereof. Thus the lower part of the member 26 is divided into a plurality of slightly flexible fingers.

Each "finger" is provided with one or more gripping elements 28 adjacent the lower end thereof, and the inner surface 29 of the lower end of each finger has a sloping configuration corresponding to the sloping configuration of the exterior of the conical parts 22 of the tubular sleeve 19.

In an initial position the member 26 is in an elevated position with the lower ends of the fingers defined by the slots 27 resting on the triangular plates 23. When in this condition, with the arms 18 of the cutter 17 retracted, the described element can be introduced to a pipe to be cut. The gripping elements 28 are designed to be a loose friction fit within the pipe, and thus the member 26 tends to ride up the tubular member 19 until the top of the member 26 engages the nut 24. The member 19 is then also moved upwardly relative to the mandrel 9 until the teeth 25 engage with the teeth 8, to constitute an engaged dog clutch.

When the spear has been lowered in the pipe to the desired level, the drill string is rotated slightly and the sleeve 19 is rotated as a consequence of engagement of the dog clutches. Due to the engagement of the gripping element 28 on the member 26, with the interior of the pipe, the tubular sleeve 19 will rotate relative to the outer member thus bringing the triangular plates 23 into alignment with the slots 27. An upward pull is applied to the drill string. The tubular member 19 thus moves upwardly relative to the outer member 26 with the plate 23 passing into the slots 27 until the sloping inner surfaces 29 of the lower ends of the fingers engage the outing slope of the conical part 22. The fingers thus spread radially outwardly and the gripping elements 28 securely engage the interior of the pipe. The upward pressure then be applied to the entire drill string will serve to reinforce the grip between the gripping elements 28 and the interior of the pipe. As a result of the upward pressure the dog clutch is disengaged. The upthrust applied by the drill string will be transferred to the member 13 and will then be transferred upwardly by means of a bearing 30 located between the upper end of the member 13 and the lower end of the tubular sleeve 19.

The cutting arms 18 of the cutter 17 may then be moved to the operative position by applying hydraulic pressure through the drill string, and the drill string may be rotated. The mandrel 7 will rotate within the tubular sleeve 19. As the member 12 rotates the cutter will cut the pipe, and when the pipe has been cut the entire assembly may be lifted safely since the cut pipe is gripped adjacent the bottom thereof and the drill string passes through the entire length of the pipe so that even if the pipe is not in a good condition the pipe can still be lifted without any significant danger of parts of the pipe falling to the sea bed.

Figure 3:
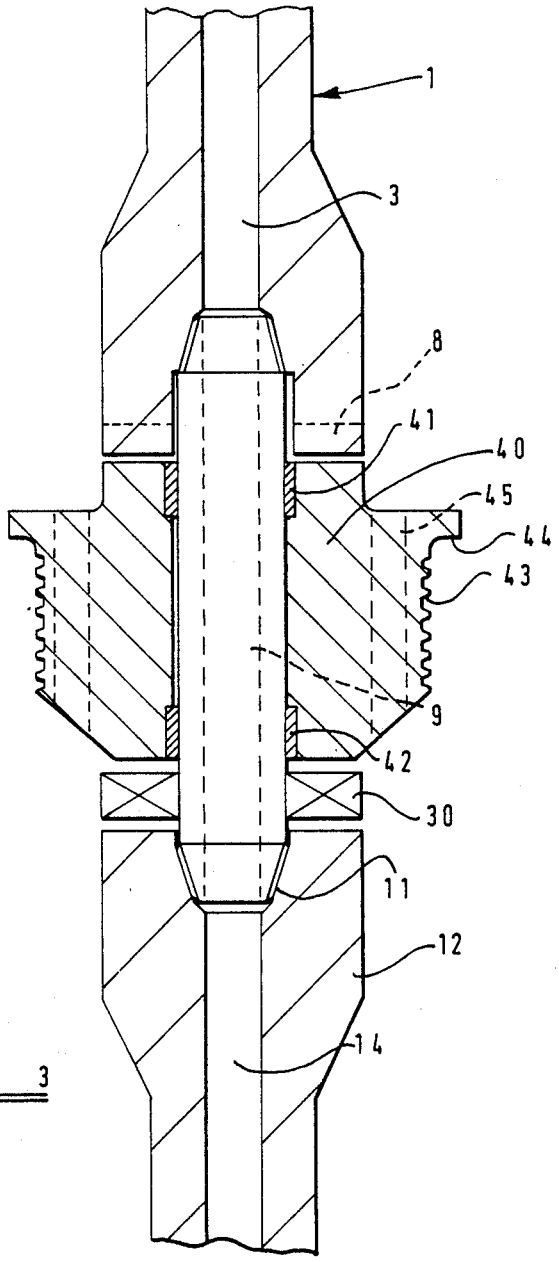
FIG. 3 is a sectional view of part of a second embodiment of the invention.

Turning now to FIG. 3 a modified embodiment of the invention is described. For the parts of the spear shown in FIG. 3 that are the same as the corresponding parts of the embodiment shown in FIGS. 1 and 2, the same reference numerals have been used, and these parts will not be described again.

In the embodiment shown in FIG. 3 instead of the gripping device consists of a single element 40 which surrounds the mandrel 9 and is supported by means of two bushes 41,42 for axial and rotational movement. The member 40 is provided with an external screw-thread 43 which terminates, adjacent the upper end thereof, with an enlarged flange 44. A plurality of bores 45 are provided which extend axially through the member 40.

When the embodiment is illustrated in FIG. 3 is utilised the drill string is lowered into a pipe until the screw threaded portion 43 engages the open mouth of the pipe, which is provided with a corresponding internal screw-threaded. The member 40 will thus be arrested while the rest of the drill string is lowered by a short distance to enable the teeth 8 provided at the lower end of the member 1 to engage corresponding teeth (not shown) provided on the upper surface of the member 40, thus constituting a dog clutch. The drill string is then rotated to enable the member 40 to be screwed into the top of the pipe until the enlarged flange 44 engages the top of the pipe. The drill string is then lifted slightly to disengage the dog clutch and to move the upper end of the member 12 into engagement with the lower end of the member 40 through the intermediary of the bearing 30. Thus the upward pressure on the drill string tends to support the pipe. The pipe can then be cut.

In the embodiment shown in FIG. 3 the bores 45 are provided through the member 40 to permit hydraulic fluid or "mud" introduced to the pipe during the cutting operation to escape readily from the pipe. Specific channels corresponding to the bores 45 are not necessary in the embodiment shown in FIGS. 1 and 2 since the hydraulic fluid or "mud" may flow up through the slots 27 between the clamping elements 28 without undue difficulty.

Turning now to FIGS. 4 and 5, again only parts of the embodiment which differ from the embodiment shown in FIGS. 1 and 2 will be described, similar parts being provided with identical reference numbers.

The mandrel 9 supports a sleeve-like member 50 which is mounted on the mandrel by means of bushes 51, 52 for axial and rotational movement relative to the mandrel 9. The sleeve-like element 50 has a waist portion 53 of enlarged diameter which defines a horizontal upper surface 54 and a horizontal lower surface 55.

An outer sleeve 56 is provided which is rotatably mounted on the sleeve 50. The sleeve 56 is provided with a radially inwardly directed flange 57 at the lower end thereof and a bearing 58 of appropriate size is located between the upper surface of the flange 57 and the horizontal lower surface 55 on the waist 53 of the tubular member 50. A ring 59 is located in a recess formed at the top of the member 56, part of the ring projecting to form an inwardly directed flange which serves to trap an appropriately designed bearing 60 between the undersurface of the ring 59 and the horizontal upper surface 54 provided at the top of the waist 53 of the tubular member 50.

It will be noted that the outer member 56 is thus rotatably mounted on the inner member 50.

The outer member 56 is provided with a radially outwardly directed lip 61 adjacent the top thereof and is provided with a plurality of axially extending bore 62 therethrough. A plurality of radially directed pins 63 are mounted in the member 56 and are biassed by means of springs 64 to a retracted position. The heads 65 of the pins 63 rest against cam faces 66 defined on the member 50. Thus, when the member 50 is rotated relative to the outer member 56 the pins 63 will be driven outwardly. The member 50 is provided with upwardly extending teeth 25 to cooperate with the dependent teeth constituting the dog clutch.

Figure 4:
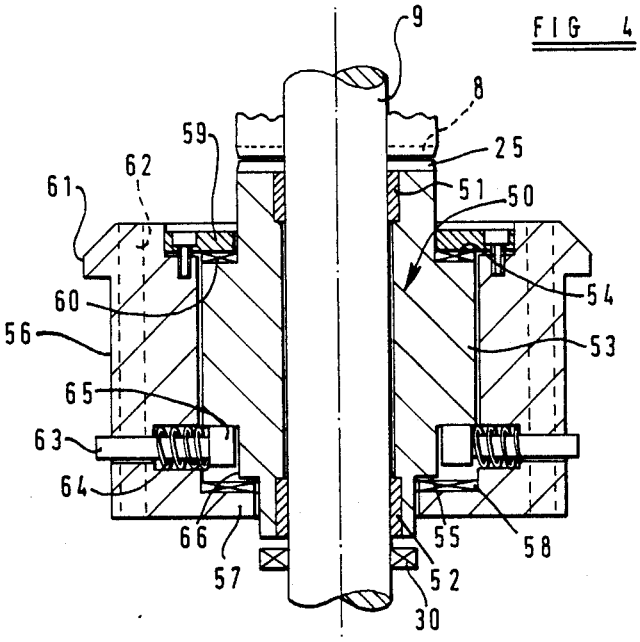
FIG. 4 is a sectional view through part of a third embodiment of the invention.
Figure 5:
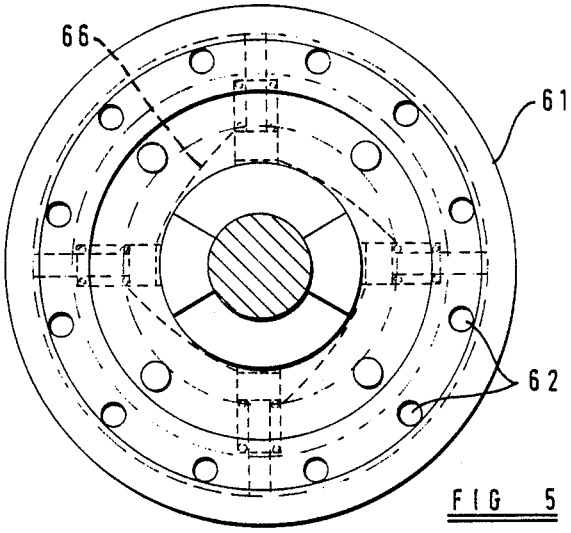
FIG. 5 is a top plan view, with some concealed parts shown in phantom, of the part of the second embodiment illustrated in FIG. 4.

When the embodiment shown in FIGS. 4 and 5 is utilised the drill string is lowered into pipe until the top of the pipe engages the undersurface of the lip 61. The drill string is then lowered a short distance further so that the teeth 25 engage with the corresponding teeth 8 of the dog clutch. The drill string is then rotated, thus rotating the member 50. Corresponding rotation of the member 56 is resisted by the engagement of the lip 61 with the top of the pipe. Consequently the member 50 rotates relative to the outer member 56 and the pins 63 are driven radially outwardly agains the spring bias applied thereto until the pins firmly grip the interior of the pipe and are firmly clamped in position. The drill string is then lifted slightly thus releasing the dog clutch. By virtue of the design of the cam faces there is no tendency for the member 50 to rotate and thus the pin 63 are retained in a clamping condition.

What is claimed is:

1. An apparatus for retrieving a pipe section from a well bore, said apparatus comprising a structure adapted to be connected to the lower end of a drilling string, said structure including a cutter at or adjacent its lower end, and controllable gripping means for gripping the interior of a pipe section, the gripping means being located above the cutter and being adapted to grip the interior of the pipe, the gripping means being such that when in a gripping condition the gripping means transfer an upward pull applied to the drilling string to the gripped pipe section and simultaneously remain stationary whilst the drilling string and the cutter are rotated to cut the pipe below the gripping means.

2. An apparatus according to claim 1, wherein the cutter is adapted to be hydraulically actuated by means of hydraulic fluid or "mud" supplied through the drilling string.

3. An apparatus according to claim 1, wherein the gripping means include a structure rotatably and axially movable on a mandrel located between an upper part of the drilling string and said cutter, dis-engageable clutch means being provided for enabling rotation of said structure on initial rotation of the drilling string, the gripping means firmly gripping the interior of the pipe as a consequence of said rotation.

4. An apparatus according to claim 1, wherein the gripping means comprise a member mounted on the mandrel for rotational and axial movement, the member defining a screw-thread on an outer portion thereof, engageable with a corresponding screw-thread provided on the interior of a pipe, the member being provided with clutch means adapted releasably to engage with corresponding clutch means provided on the next adjacent member of the drill string.

5. An apparatus according to claim 1, wherein the gripping means comprise an assembly mounted on the mandrel for axial and rotational movement, the assembly being provided with clutch means to engage with corresponding clutch means on the next adjacent member of the drill string, the assembly being such that when a rotational movement is imparted to part thereof a plurality of gripping elements are moved radially outwardly to engage the interior of the pipe.

6. An apparatus according to claim 5, wherein the assembly comprises an inner element mounted on the mandrel for axial and rotational movement, and an outer element is rotatably mounted on the inner element, the outer element carrying a plurality of radially movable inwardly spring biassed pins, the inner element defining cam faces cooperating with the heads of the pins such that on movement of the inner member relative to the outer member the pins are moved radially outwardly.

7. An apparatus according to claim 4, wherein said clutch means is a dog clutch.

8. An apparatus according to claim 6, wherein said clutch means is a dog clutch.

9. An apparatus for retrieving a pipe section from a well bore, said apparatus comprising:

a structure adapted to be connected to the lower end of a drilling string, said structure including a cutter at or adjacent its lower end;

controllable gripping means for gripping the interior of a pipe section;

the gripping means being located above the cutter and being adapted to grip the interior of the pipe;

the gripping means being such that when in a gripping condition the gripping means may remain stationary whilst the drilling string and the cutter are rotated;

the gripping means including a structure rotatably and axially movable on a mandrel located between an upper part of the drilling string and said cutter;

disengageable clutch means being provided for enabling rotation of said structure on initial rotation of the drilling string, the gripping means firmly gripping the interior of the pipe as a consequence of said rotation;

the gripping means including an inner sleeve mounted on the mandrel for rotational and axial movement relative thereto;

the inner sleeve being provided at its upper end, with teeth engageable with corresponding teeth provided at the lower most end of the next adjacent element in the drill string to constitute the said disengageable clutch means;

the inner sleeve being provided with cam means adjacent the lower end thereof;

an outer tubular member surrounding the inner sleeve defining, adjacent its lower end, a plurality of flexible fingers the ends of which carry gripping elements;

the outer tubular member being adapted to be maintained initially in an elevated position relative to the inner sleeve; and rotation of the inner sleeve permitting the outer tubular member to move to a lower position when the ends of the fingers engage the cam surfaces so that the ends of the fingers are moved radially outwardly to grip the interior of the pipe securely.

10. An apparatus according to claim 9, wherein the outer tubular member is provided with a plurality of slots between said fingers and the inner tubular member is provided with a plurality of abutment members, the arrangement being such that initially the abutment members engage the ends of said fingers, but on rotation of the inner tubular member the abutment members are brought into co-alignment with said slots, thus permitting the outer member to move downwardly relative to the inner sleeve.

* * * * *

UNITED STATES PATENT AND TRADEMARK OFFICE

CERTIFICATE OF CORRECTION

PATENT NO. : 4,969,514

DATED : November 13, 1990

INVENTOR(S) : George H.O. Morris et al

It is certified that error appears in the above-identified patent and that said Letters Patent is hereby corrected as shown below:

On Title page, add--[73] Assignee:

Smith International, Inc., Houston, Texas --.

Signed and Sealed this

Twenty-eighth Day of July, 1992

*Attest:*

DOUGLAS B. COMER

*Attesting Officer*

*Acting Commissioner of Patents and Trademarks*